United States Patent [19]

Hodges

[11] Patent Number: 4,607,995

[45] Date of Patent: Aug. 26, 1986

[54] STACKING AND COLLECTING APPARATUS

[75] Inventor: William D. Hodges, London, England

[73] Assignee: Machines Chambon S.A., Orleans, France

[21] Appl. No.: 743,725

[22] Filed: Jun. 11, 1985

[30] Foreign Application Priority Data

Jun. 15, 1984 [GB] United Kingdom ..... 8415359

[51] Int. Cl.[4] ..... B65H 31/30; B65H 31/32

[52] U.S. Cl. ..... 414/46; 198/468.7; 271/218; 414/45; 414/50; 414/98; 414/786

[58] Field of Search ..... 414/43, 45, 46, 50, 414/98, 786; 271/218; 198/468.7

[56] References Cited

U.S. PATENT DOCUMENTS

| | | | |
|---|---|---|---|
| 3,107,912 | 10/1963 | Fiehl | 271/215 |
| 3,221,902 | 12/1965 | Young | 414/46 |
| 3,233,718 | 2/1966 | Ladewig et al. | 198/468.7 X |
| 3,306,475 | 2/1967 | Mays | 271/218 X |
| 3,659,728 | 5/1972 | Reinecke | 414/46 |
| 3,759,402 | 9/1973 | Hitch et al. | 271/217 |
| 4,019,640 | 4/1977 | Marin et al. | 271/218 X |
| 4,190,241 | 2/1980 | Krueger | 270/47 |

FOREIGN PATENT DOCUMENTS

| | | |
|---|---|---|
| 2725267 | 11/1978 | Fed. Rep. of Germany . |
| 3043035 | 6/1982 | Fed. Rep. of Germany . |

*Primary Examiner*—Leslie J. Paperner

*Attorney, Agent, or Firm*—Sughrue, Mion, Zinn, Macpeak and Seas

[57] ABSTRACT

Apparatus for stacking and collecting labels includes a suction drum for continuously feeding at least one stream of individual labels to a movable support assembly. The movable support assembly supports a respective stack of labels corresponding to the or each stream fed thereto by the suction drum. A fixed support assembly is provided for receiving the or each stack of labels from the movable support assembly. The movable support assembly is movable relative to the fixed support assembly, firstly to transfer the or each stack of labels to the fixed support assembly, and secondly to push the or each stack of labels off the fixed support assembly. An intermediate support assembly is provided for supporting labels while the movable support assembly pushes the or each stack off the fixed support assembly.

25 Claims, 9 Drawing Figures

STACKING AND COLLECTING APPARATUS

BACKGROUND TO THE INVENTION

This invention relates to apparatus for, and a method of, stacking and collecting labels, and in particular to automatic stacking and collecting apparatus for individual paper or paper laminate labels produced on a web printing machine.

A known label stacking apparatus includes a plurality of sets of suction discs. Each set of suction discs receives successive labels from a respective stream of labels fed thereto from a web printing machine by a respective pair of suction belts. The suction discs hold the leading edges of the labels by suction through holes in their peripheral edges. The discs rotate the labels through 90°, after which the labels are stripped off by an intercepting horizontal table. The stacks of labels are then removed by hand for a subsequent banding operation.

This known apparatus has a major disadvantage, namely that the stacks must be manually removed for banding, or for putting into a ram punching machine. This disadvantage is exacerbated as the operating speed of the apparatus increases; which, with a modern high-speed web printing machine, can be a serious limitation. Another disadvantage of this known apparatus is that it cannot handle long labels (that is to say labels having a length greater than about 160 millimeters).

The aim of the invention is to provide apparatus for, and a method of, stacking and collecting labels which do not suffer from the disadvantages mentioned above, even when the stacking and collecting is done downstream of a high-speed web printing machine, and the labels concerned are long.

SUMMARY OF THE INVENTION

The present invention provides apparatus for stacking and collecting labels, the apparatus comprising feed means for continuously feeding at least one stream of individual labels, a movable support assembly for supporting a respective stack of labels corresponding to the or each stream fed thereto by the feed means, and a fixed support assembly for receiving the or each stack of labels from the movable support assembly, the movable support assembly being movable relative to the fixed support assembly firstly to transfer the or each stack of labels to the fixed support assembly, and secondly to push the or each stack of labels off the fixed support assembly, wherein an intermediate support assembly is provided for supporting labels whilst the movable support assembly pushes the or each stack off the fixed support assembly.

The movable support assembly of this apparatus thus acts as a support for the stack(s) of labels as these are delivered by the feed means, and as means for automatically pushing the stack(s) away from the apparatus for banding. Whilst the movable support assembly carries out the pushing step, the intermediate support assembly intercepts the flow of labels, so that the apparatus can operate continuously with an upstream web printing machine.

Advantageously, the apparatus further comprises a transfer carriage positioned adjacent to the fixed support assembly in such a position as to receive the or each stack of labels as it is pushed off the fixed support assembly by the movable support assembly.

The feed means may be constituted by a suction drum including a respective set of suction discs for each stream of labels, each suction disc being provided with at least one series of suction holes in its periphery.

Advantageously, the movable support assembly is constituted by a plurality of parallel, equi-spaced plates, said plates being mounted at one end of a common support arm, the other end of the support arm being pivotally mounted in the housing of the apparatus. Preferably, the fixed support assembly is constituted by a plurality of parallel, equi-spaced plates, the plates of the fixed support assembly being so positioned that the plates of the movable support assembly can pass therebetween. Conveniently, the plates of both assemblies have convex upper edges.

In a preferred embodiment, each plate of the fixed support assembly is provided with an upright extending generally at right-angles thereto and at one end thereof. The apparatus may further comprise a respective stripping finger associated with the or each stream of labels, the or each stripping finger being positioned adjacent to the suction drum so as to strip the labels of the associated stream away from the drum. In this case, the or each stripping finger is spaced by substantially 150° around the periphery of the suction drum from the point where the associated stream of labels meets the suction drum; and the arcuate span between the two end suction holes of each series of suction holes in the suction discs is equal to the distance between the point where the labels are stripped away from the suction drum by the associated stripping finger and the uprights of the fixed support assembly. This permits the labels to be placed on the stack(s) rather than being thrown, and so leads to a uniformity or stacking irrespective of the speed of the upstream machine. Moreover, because the suction holes extend round an arc of each of the suction discs, the labels are held over a considerable distance as they "roll" over the suction discs, so that the apparatus can also handle long labels.

Advantageously, the common support arm of the movable support assembly is reciprocable in the direction of its longitudinal axis by means of a ram. This ram can be used to move the movable support assembly relative to the fixed support assembly so as to transfer the stack(s) of labels to the fixed support assembly. Preferably, said ram is an air-operated, pressure-intensified oil dosing ram which is extended by air operation and retracted incrementally by doses of oil.

The movable support assembly may be rotatable about said other end of the support arm by a pneumatic ram assembly. This ram assembly can be used to push the stack(s) of labels off the fixed support assembly. Preferably, the pneumatic ram assembly is constituted by a long-stroke pneumatic ram and a short-stroke pneumatic ram.

The intermediate support assembly may be constituted by a bar and a respective counting finger aligned with the or each stream of labels, the arrangement being such that the or each counting finger is interposed between the feed means and the associated previously-positioned stack of labels when a predetermined number of labels have been fed to said stack. Advantageously, the or each counting finger is provided with a suction hole in the upper surface for retaining the first label fed thereto after the predetermined number of labels has been fed to the associated stack.

The apparatus may further comprise an electronic batch counter for counting the number of labels fed to the or each stack. Advantageously, the bar is rotatable about its longitudinal axis by a pneumatic ram, said pneumatic ram being controlled by a signal from the electronic batch counter. Preferably, the bar is reciprocable towards, and away from, the feed means by a further pneumatic ram.

The invention also provides a method of stacking and collecting labels, the method comprising the steps of feeding at least one stream of individual labels to a movable support assembly, the feed means being such as to deposit successive labels of the or each stream in a respective stack on the movable support assembly, moving the movable support assembly in a first direction relative to a fixed support assembly so that the or each stack of labels is transferred to the fixed support assembly, and moving the movable support assembly in a second direction relative to the fixed support assembly to push the or each stack of labels off the fixed support assembly.

The movable support assembly may be moved linearly with respect to the fixed support assembly in said first direction, and may be moved arcuately with respect to the fixed support assembly in said second direction.

Advantageously, the method further comprises the step of positioning an intermediate support assembly in the path of the labels as they are moved towards the movable support assembly when a predetermined number of labels have been delivered to the or each stack, whereby subsequently fed labels of the or each stream form a respective new stack on the intermediate support assembly. In this case, the method may further comprise the step of withdrawing the intermediate support assembly after the movable support assembly has pushed the or each stack of labels off the fixed support assembly, whereby the or each new stack carried by the intermediate support assembly is transferred to the movable support assembly.

BRIEF DESCRIPTION OF THE DRAWINGS

Apparatus for stacking and collecting labels and constructed in accordance with the invention will now be described in detail, by way of example, with reference to the accompanying drawings, in which.

DESCRIPTION OF PREFERRED EMBODIMENTS

Figure 1:
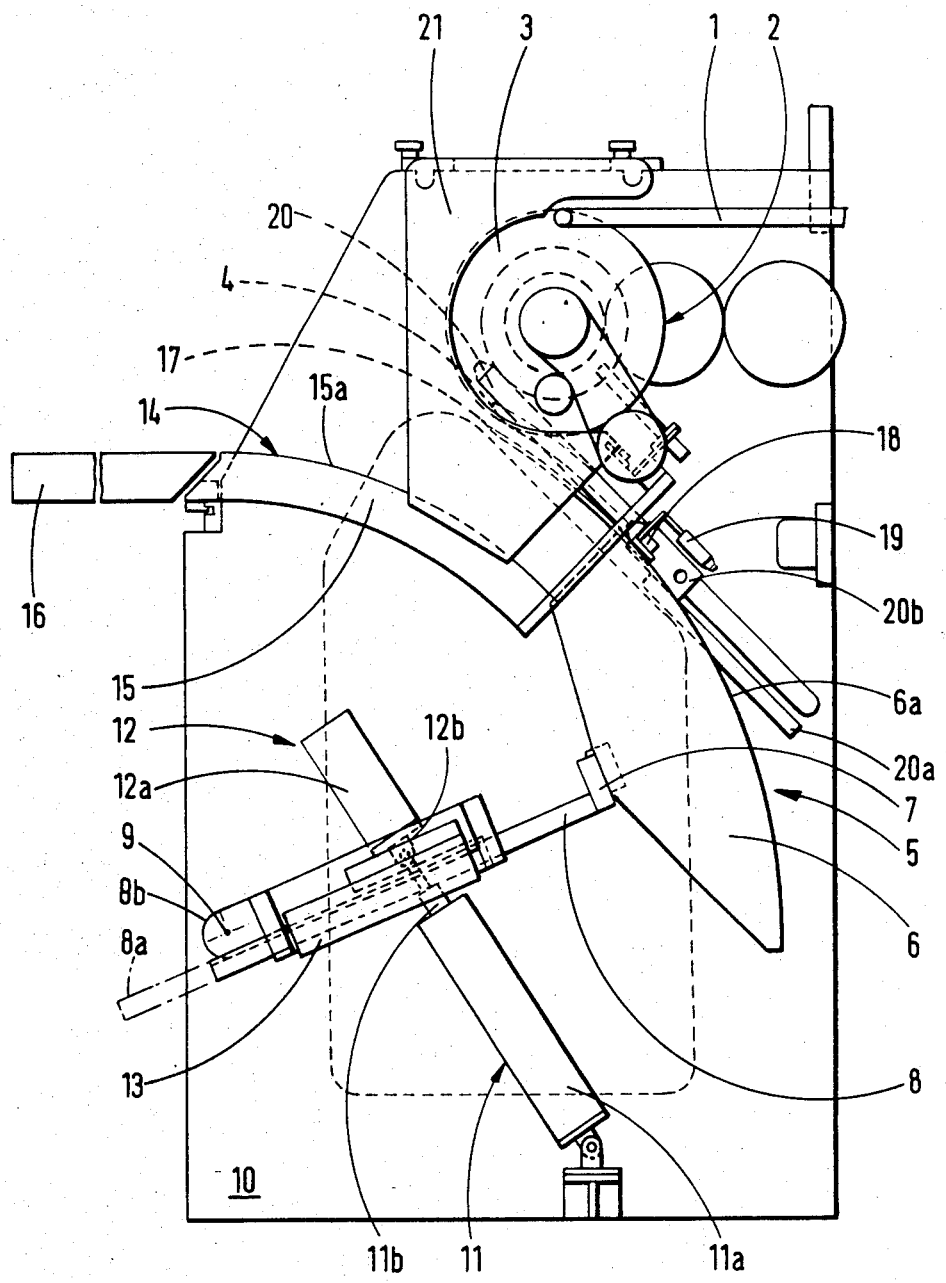
FIG. 1 is a schematic side elevation of the apparatus.
Figure 2:
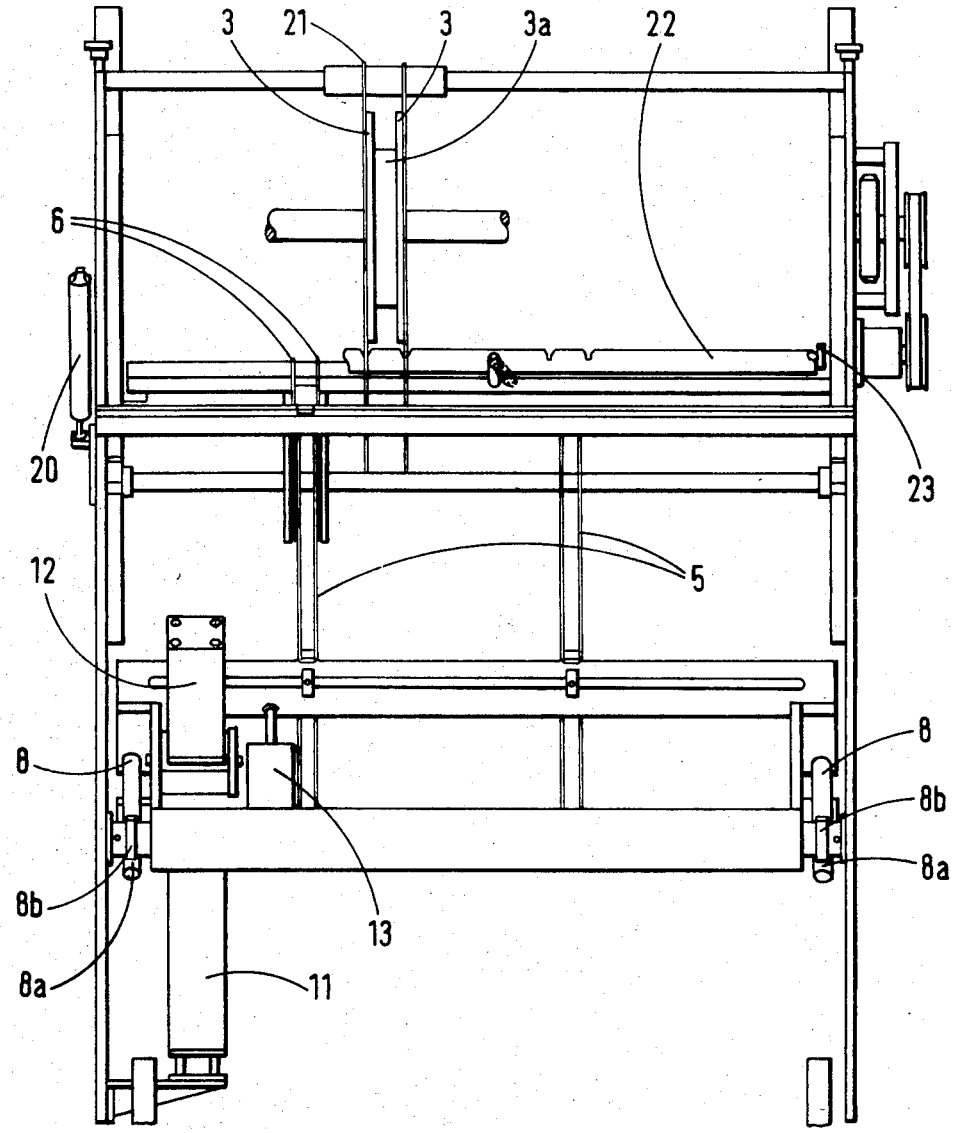
FIG. 2 is an end elevation of the apparatus.

Referring to the drawings, FIGS. 1 and 2 show apparatus for collecting and stacking labels, the apparatus being positioned downstream of machinery (not shown) used to print the labels to cut the labels to size. The apparatus comprises a plurality of suction belts 1 (only one of which can be seen in FIG. 1). Each suction belt 1 carries a respective stream of printed and cut labels from the upstream machinery to a suction drum 2. The suction drum 2 has a plurality of sets of hollow suction discs 3 (only one of which can be seen in FIG. 1). Each set of suction discs 3 is aligned with a respective suction belt 1 so as to pick up the labels of the associated stream as they leave the suction belt. Typically, there are two suction discs 3 in each set, the discs of each set being associated with a respective manifold 3*a* (see FIG. 2). Each suction disc 3 is formed with a plurality (say three) of series of suction holes (not shown) in its circumferential edge. The suction holes of each of the suction discs 3 extend over an arc of 160 millimeters length, so that the labels are held to the suction discs over a considerable distance as they "roll" round the suction discs. This enables the apparatus to handle long labels (that is to say labels longer than about 160 millimeters). The hollow interiors of the manifolds 3*a* of the suction discs 3 are connected to a vacuum pump (not shown), as are the suction belts 1.

The suction discs 3 are arranged to carry the labels through 150°, and then to deposit them in stacks as described below. Accordingly, stripping fingers 4 (only one of which can be seen in FIG. 1) are positioned to strip the leading edges of the labels once the labels have been carried through 150°. The stripping fingers 4 are arranged between adjacent support discs 3 of each set. As the labels are stripped away from their sets of suction discs 3, they are precisely deposited on a movable support assembly 5. This assembly 5 is constituted by a plurality of equi-spaced parallel plates 6 (only one of which can be seen in FIG. 1), each of which has a convex upper support edge 6*a*. The plates 6 are attached to a support bar 7, which in turn is mounted on one end of a support arm 8. The other end of the support arm 8 is pivotally mounted, at 9, to the frame 10 of the apparatus. The movable support assembly 5 can be rotated about the pivot 9 by a compound pneumatic ram system constituted by a long-stroke ram 11 and a short-stroke ram 12. The cylinders 11*a* and 12*a* of the rams 11 and 12 are pivotally mounted on the frame 10, and their piston rods 11*b* and 12*b* are pivotally attached to the support arm 8. The support arm 8 is attached to a pair of tied racks 8*a* (only one of which is shown), and is reciprocable by a ram 13 to raise and lower the movable support assembly 5. The ram 13 is an air-on-oil ram, lowering of the support arm 7 being effected by an air-operated, pressure-intensified oil dosing arrangement. The tied racks 8*a* cooperate with pinions 8*b* to ensure that the support arm 8 moves in parallelism.

The movable support assembly 5 cooperates with a fixed support assembly 14. This assembly 14 is constituted by a plurality of equi-spaced parallel plates 15 (only one of which can be seen in FIG. 1), each of which has a convex upper support edge 15*a* and an upright 15*b*. The uprights 15*b* define a back stop against which the stacks of labels can rest. The convex support edges 15*a* and the convex support edges 6*a* have different radii of curvature. The plates 15 are positioned so that the plates 6 of the movable support assembly 5 can pass therebetween. This enables stacks of labels deposited on the movable support assembly 5 to be transferred to the fixed support assembly 14 (as is described below). After the stacks of labels have been transferred to the fixed support assembly 14, they are pushed by the movable support assembly 5 on to a transfer carriage 16, as is described in detail below.

In order that a predetermined number of labels may be positioned in each of the stacks, count fingers 17 (only one of which can be seen in FIG. 1) are provided. A respective count finger 17 is provided for each stack, and the count fingers are all mounted on a common equipment bar 18. The bar 18 is rotatable about its central longitudinal axis by means of a pneumatic ram 19. The bar 18 is also movable into, and out of, an operating position by a pneumatic ram 20. The ram 20 is effective to move the bar 18 towards, and away from, the suction drum 2. During this reciprocal movement, the bar 18 is guided between rails (not shown), and is connected to the ram 20 by a rack 20*a* and a pinion 20*b*. The operation of the count fingers 17 is controlled by an electronic batch counter (not shown).

The apparatus also includes a plurality of stack separator plates 21 (only one of which can be seen in FIG. 1). These plates 21 extend between the stacks of labels, and are arranged to oscillate transversely, thereby ensuring that the labels in all the stacks have their lateral edges accurately aligned. The plates 21 are mounted on a bar 22 which is movable backwards and forwards by an oscillating mechanism 23.

Figure 3A:
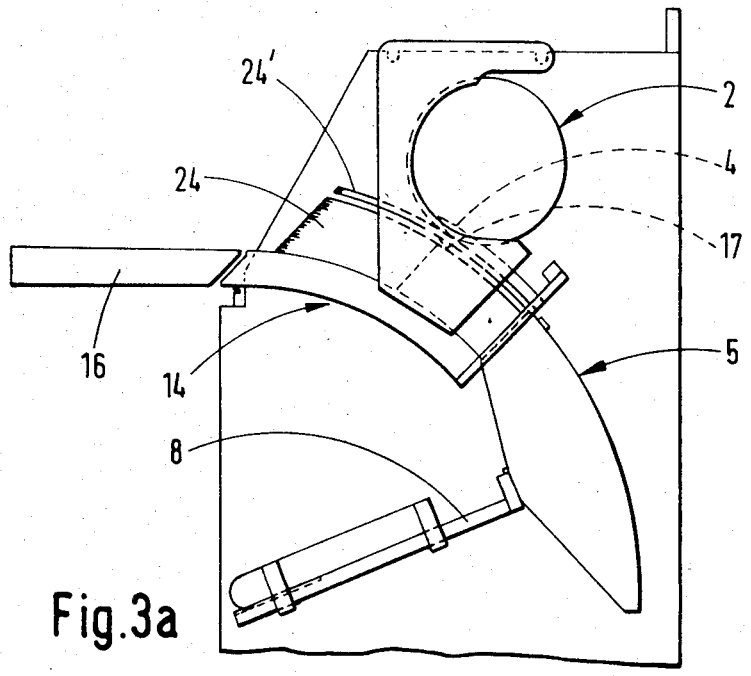
FIGS. 3*a* to 3*g* are schematic side elevations showing successive operating positions of the apparatus.

The operation of the stacking apparatus will now be described with reference to FIGS. 3*a* to 3*g*. FIG. 3*a* shows the apparatus in the position in which stacks 24 (only one of which can be seen) have been transferred from the movable support assembly 5 to the fixed support assembly 14, the movable support assembly is in an intermediate position, and the count fingers 17 have been moved forward to intercept the flow of labels and start new stacks 24'. This movement of the count fingers 17 is initiated by a control signal from the electronic batch counter, which actuates the ram 19 to pivot the bar 18 so as to move the count fingers into the position shown in FIG. 3*a*. The electronic batch counter is arranged to emit the control signal after it has counted a predetermined number of labels (say 1000).

Figure 3B:
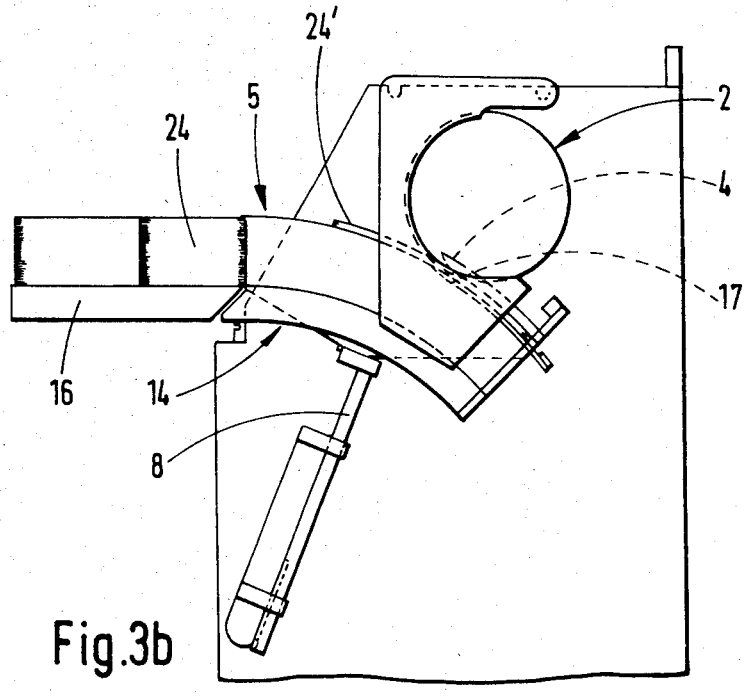

The movable support assembly 5 is then actuated to push the stacks 24 along the plates 15 of the fixed support assembly 14, and on to the transfer carriage 16 (see FIG. 3*b*). This is accomplished by rotating the assembly 5 about its pivot 9 by the long-stroke ram 11. The short-stroke ram 12, which at this stage is fully extended, takes no part in this movement. At this stage, the labels delivered by the suction drum 2 pile up on the count fingers 17, forming the new stacks 24'. The stacks 24 can then be moved laterally to one or more banding modules, after which they are removed for transportation.

Figure 3C:
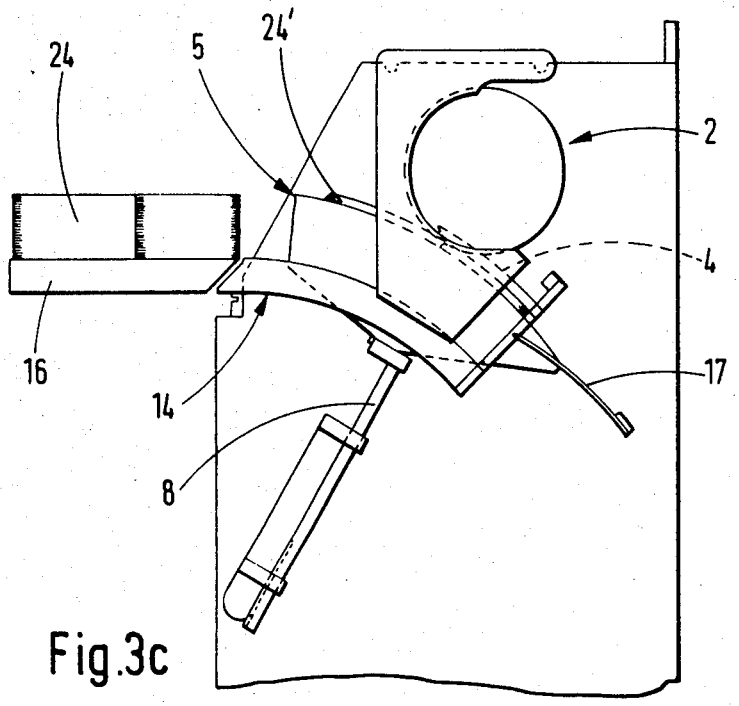

The movable support assembly 5 is then retracted a short distance to provide an operating clearance between the plates 6 and the transfer carriage 16 (see FIG. 3*c*). At the same time, the count fingers 17 are retracted. The part-way retraction of the movable support assembly 5 is effected by the retraction of the short-stroke ram 12; and the count fingers 17 are retracted (together with the bar 18) by retracting the ram 20.

Figure 3D:
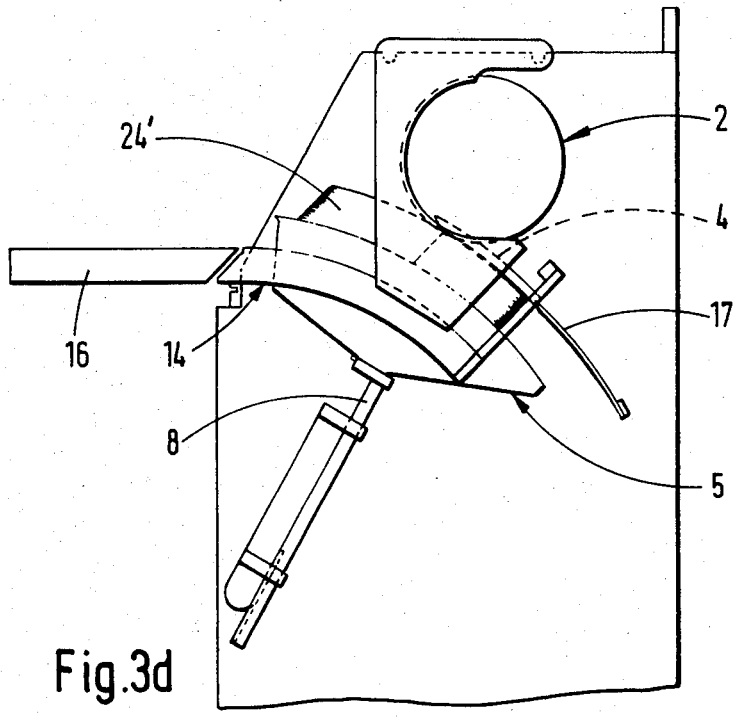

As the suction drum 2 feeds more and more labels on to the stacks 24', the movable support assembly 5 is lowered (see FIG. 3*d*). At the same time, the count fingers 17 are raised. The assembly 5 is lowered by the ram 13, air-operated, pressure-intensified oil doses being fed to the ram 13 in a controlled manner in dependence upon signals received from the electronic batch counter. In this way, the movable support assembly 5 is lowered at a controlled rate which is proportional to the rate of stack growth. The count fingers 17 are raised by rotating the bar 18 using the ram 19.

Figure 3E:
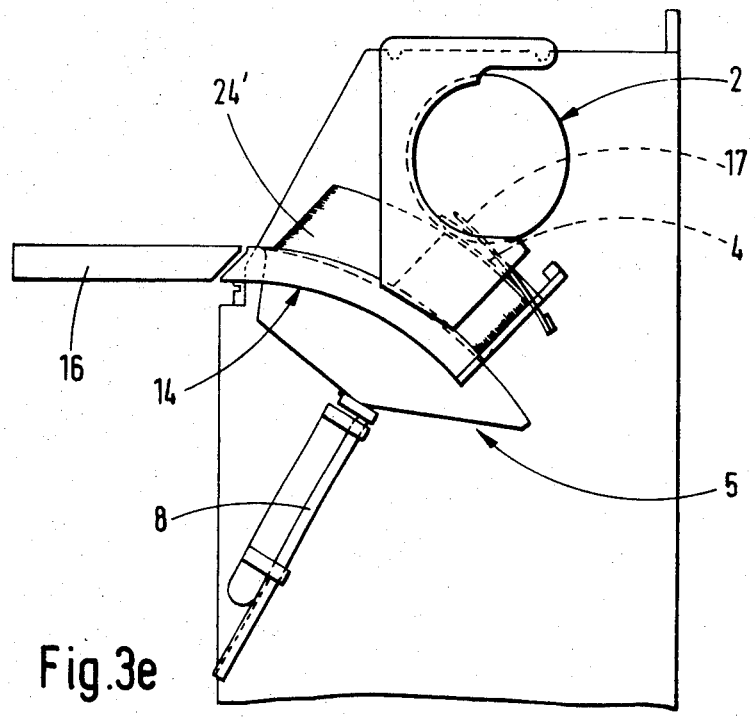

The count fingers 17 are then moved back towards the suction drum 2, whilst the movable support assembly 5 continues to be lowered until the convex upper edges 6*a* of its plates 6 lie below the convex upper edges 15*a* of the plates 15 of the fixed support assembly 14 (see FIG. 3*e*). The stacks 24' then rest on the fixed support assembly 14. The count fingers 17 are moved back towards the suction drum 2 by the ram 20.

Figure 3F:
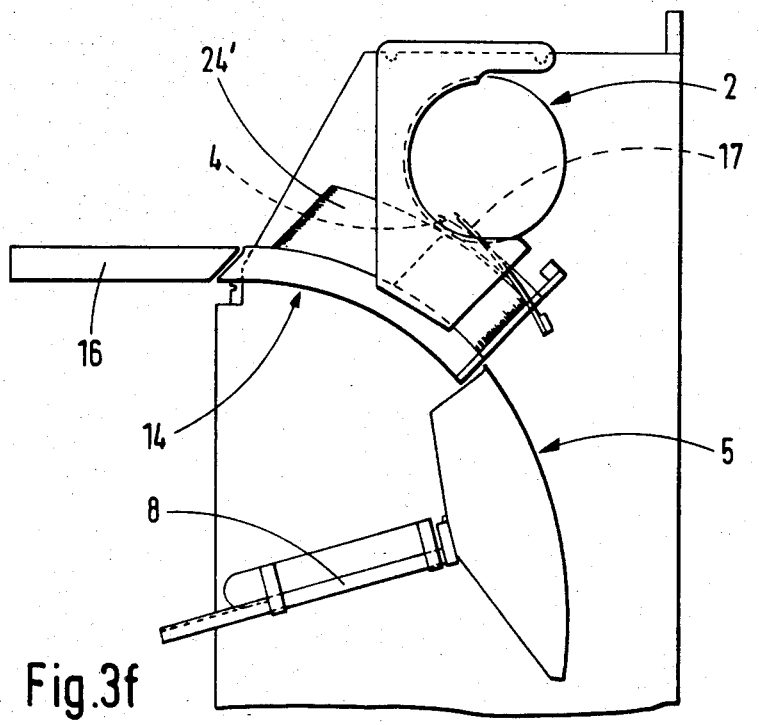
Figure 3G:
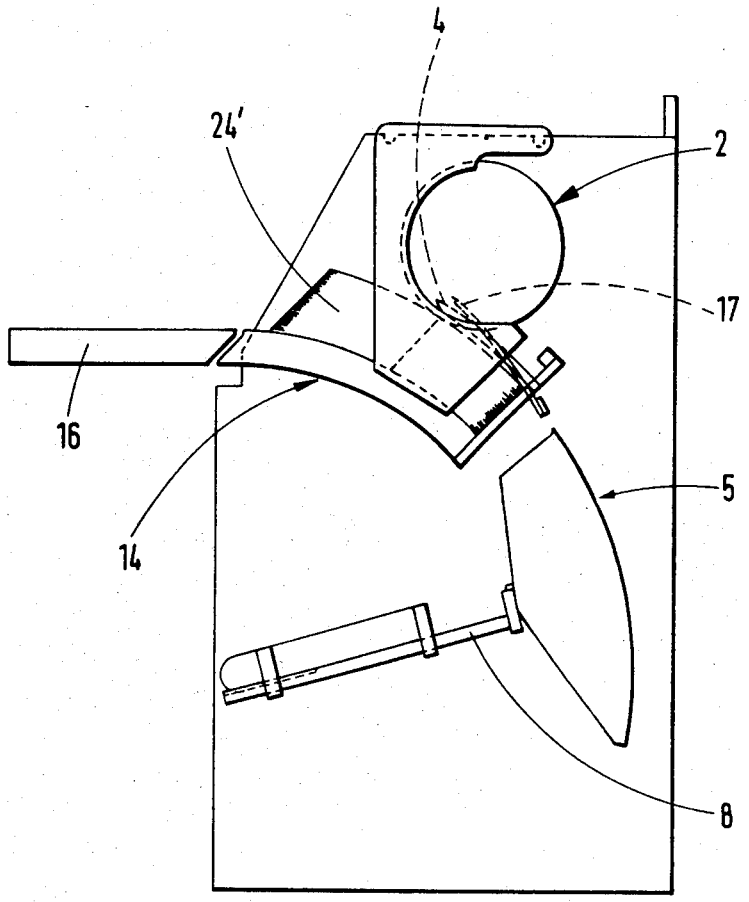

The movable support assembly 5 is then rotated fully down by retracting the long-stroke ram 11 (see FIG. 3*f*). The assembly 5 is then raised relative to its support arm 8 by fully extending the ram 13 (see FIG. 3*g*). This brings the movable support assembly 5 into alignment with the stacks 24'. This step is immediately followed by a partial rotation of the movable support assembly 5, about the pivot 9, to bring the apparatus into the start position. This is accomplished by extending the short-stroke ram 12. The apparatus is now in position to repeat the cycle upon receipt of the control signal from the batch counter.

It should be noted that the apparatus is such that each label is held on the suction drum 2 by suction through series of holes in the associated sets of suction discs 3, so that it is rotated through 150°, and deposited precisely to the back of a pocket formed by the previously-delivered label and the back stop defined by the uprights 15*b* of the plates 15 of the fixed support assembly 14. The arcuate span of the first and last holes in each series of holes is arranged to be equal to the distance from the point where a label is stripped from the suction discs 3 (by the stripping fingers 4) to the back stop. Suction is applied to each hole of a series consecutively at the transfer point at the top of the associated suction disc 3 (that is to say at the point where a label is transferred to the suction drum 2 from the upstream suction belts 1), and cut off 150° later at the stripping point. This is accomplished by a stationary annular valve (not shown). As a result of this arrangement, the labels are laid on their stacks, rather than being thrown against the back stop.

It will be apparent that the apparatus described above could be modified in a number of ways. For example, depending upon the width of the labels, each stream of labels could be handled by two or more suction belts (and accordingly by two or more sets of suction discs).

Although the apparatus described above is used to stack and collect labels (particularly paper labels or paper laminate labels), it will be appreciated that it could also be used to stack and collect other similar flat flexible articles, and the term "labels" should be construed accordingly throughout this specification.

I claim:

1. Apparatus for stacking and collecting labels, the apparatus comprising feed means for continuously feeding at least one stream of individual labels, a movable support assembly for supporting at least one stack of labels corresponding to said at least one stream fed thereto by the feed means, and a fixed support assembly for receiving said at least one stack of labels from the movable support assembly, the movable support assembly being movable relative to the fixed support assembly firstly to transfer said at least one stack of labels to the fixed support assembly, and secondly to push said at least one stack of labels off the fixed support assembly, wherein an intermediate support assembly is provided for supporting labels whilst the movable support assembly pushes said at least one stack off the fixed support assembly.

2. Apparatus according to claim 1, further comprising a transfer carriage positioned adjacent to the fixed support assembly in such a position as to receive said at least one stack of labels as it is pushed off the fixed support assembly by the movable support assembly.

3. Apparatus according to claim 1, wherein the feed means comprises a suction drum.

4. Apparatus according to claim 3, wherein the suction drum includes a respective set of suction discs for each stream of labels, each suction disc being provided with at least one series of suction holes in its periphery.

5. Apparatus according to claim 4, wherein the movable support assembly comprises a plurality of parallel, equi-spaced plates, said plates being mounted at one end of a common support arm, the other end of the support arm being pivotally mounted in the housing of the apparatus.

6. Apparatus according to claim 5, wherein the plates of the movable support assembly have convex upper edges.

7. Apparatus according to claim 6, wherein the fixed support assembly comprises a plurality of parallel, equi-spaced plates, the plates of the fixed support assembly being so positioned that the plates of the movable support assembly can pass therebetween.

8. Apparatus according to claim 7, wherein the plates of the fixed support assembly have convex upper edges.

9. Apparatus according to claim 7, wherein each plate of the fixed support assembly is provided with an upright extending generally at right-angles thereto and at one end thereof.

10. Apparatus according to claim 9, further comprising at least one stripping finger associated with said at least one stream of labels, said at least one stripping finger being positioned adjacent to the suction drum so as to strip the labels of the associated stream away from the drum.

11. Apparatus according to claim 10, wherein said at least one stripping finger is spaced by substantially 150° around the periphery of the suction drum from the point where the associated stream of labels meets the suction drum.

12. Apparatus according to claim 10, wherein the arcuate span between the two end suction holes of each series of suction holes in the suction discs is equal to the distance between the point where the labels are stripped away from the suction drum by the associated stripping finger and the uprights of the fixed support assembly.

13. Apparatus according to claim 5, wherein the common support arm of the movable support assembly is reciprocable in the direction of its longitudinal axis by means of a ram.

14. Apparatus according to claim 13, wherein said ram is an air-operated, pressure-intensified oil dosing ram which is extended by air operation and retracted incrementally by doses of oil.

15. Apparatus according to claim 13, wherein the movable support assembly is rotatable about said other end of the support arm by a pneumatic ram assembly.

16. Apparatus according to claim 15, wherein the pneumatic ram assembly is a long-stroke pneumatic ram and a short-stroke pneumatic ram.

17. Apparatus according to claim 1, wherein the intermediate support assembly comprises a bar and at least one counting finger aligned with said at least one stream of labels, the arrangement being such that said at least one counting finger is interposed between the feed means and the associated previously-positioned stack of labels when a predetermined number of labels have been fed to said stack.

18. Apparatus according to claim 17, wherein said at least one counting finger is provided with a suction hole in the upper surface for retaining the first label fed thereto after the predetermined number of labels has been fed to the associated stack.

19. Apparatus according to claim 17, further comprising an electronic batch counter for counting the number of labels fed to said at least one stack.

20. Apparatus according to claim 17, wherein the bar is rotatable about its longitudinal axis by a pneumatic ram, said pneumatic ram being controlled by a signal from the electronic batch counter.

21. Apparatus according to claim 20, wherein the bar is reciprocable towards, and way from, the feed means by a further pneumatic ram.

22. A method of stacking and collecting labels, the method comprising the steps of feeding at least one stream of individual labels to a movable support assembly, the feed means being such as to deposit successive labels of said at least one stream in a respective stack on the movable support assembly, moving the movable support assembly in a first direction relative to a fixed support assembly so that said at least one stack of labels is transferred to the fixed support assembly, and moving the movable support assembly in a second direction relative to the fixed support assembly to push said at least one stack of labels off the fixed support assembly.

23. A method according to claim 22, wherein the movable support assembly is moved linearly with respect to the fixed support assembly in said first direction, and is moved arcuately with respect to the fixed support assembly in said second direction.

24. A method according to claim 23, further comprising the step of positioning an intermediate support assembly in the path of the labels as they are moved towards the movable support assembly when a predetermined number of labels have been delivered to said at least one stack, whereby subsequently fed labels of said at least one stream form a respective new stack on the intermediate support assembly.

25. A method according to claim 24, further comprising the step of withdrawing the intermediate support assembly after the movable support assembly has pushed said at least one stack of labels off the fixed support assembly, whereby said at least one new stack carried by the intermediate support assembly is transferred to the movable support assembly.

* * * * *